US007478771B2

(12) United States Patent
Whittaker

(10) Patent No.: US 7,478,771 B2
(45) Date of Patent: Jan. 20, 2009

(54) METHODS FOR RECRUSHING ROCKS AND REMOVING FINES THEREFROM

(75) Inventor: Mitchell L. Whittaker, Mocksville, NC (US)

(73) Assignee: Vulcan Materials Company, Birmingham, AL (US)

( * ) Notice: Subject to any disclaimer, the term of this patent is extended or adjusted under 35 U.S.C. 154(b) by 619 days.

(21) Appl. No.: 11/195,699

(22) Filed: Aug. 3, 2005

(65) Prior Publication Data

US 2007/0029417 A1 Feb. 8, 2007

(51) Int. Cl.
*B02B 5/02* (2006.01)
*B03B 7/00* (2006.01)

(52) U.S. Cl. ..... 241/29; 241/78; 241/81

(58) Field of Classification Search ..... 241/19, 241/29, 78, 81
See application file for complete search history.

(56) References Cited

U.S. PATENT DOCUMENTS

| | | | | |
|---|---|---|---|---|
| 37,362 | A | | 1/1863 | Siddall |
| 197,897 | A | | 12/1877 | Rice |
| 309,043 | A | | 12/1884 | Goodyear |
| 696,604 | A | | 4/1902 | Stebbins |
| 775,944 | A | | 11/1904 | Stebbins |
| 1,665,806 | A | * | 4/1928 | Bing ..... 241/19 |
| 1,760,245 | A | | 5/1930 | Lykken |
| 2,236,548 | A | * | 4/1941 | Prouty ..... 241/41 |
| 2,474,314 | A | | 6/1949 | Koehne |
| 2,662,694 | A | | 12/1953 | Lotz |
| 2,971,702 | A | | 2/1961 | Lykken et al. |
| 3,062,458 | A | | 11/1962 | Dearing |
| 3,513,858 | A | | 5/1970 | Pietrucci |
| 3,856,217 | A | * | 12/1974 | Brewer ..... 241/79.1 |
| 3,929,293 | A | | 12/1975 | Hahn et al. |
| 4,037,794 | A | | 7/1977 | Melliger |
| 4,037,796 | A | | 7/1977 | Francis |
| 4,196,860 | A | | 4/1980 | Williams |
| 4,550,879 | A | | 11/1985 | Tanaka et al. |
| 5,529,254 | A | | 6/1996 | McIntyre et al. |
| 5,850,977 | A | | 12/1998 | Csendes |
| 6,565,025 | B2 | | 5/2003 | Zortman et al. |

* cited by examiner

*Primary Examiner*—Bena Miller
(74) *Attorney, Agent, or Firm*—Buchanan Ingersoll & Rooney PC

(57) ABSTRACT

Crushed rock is produced by passing rocks through an early stage rock crusher. Crushed rocks that exit the early stage rock crusher are passed across a sizing device. Rocks failing to pass completely through the sizing device are recrushed in a later-stage rock crusher and then passed downwardly through a high-volume air stream which flows within the crusher transversely through the downwardly traveling crushed rocks and extracts fines therefrom prior to exiting of the crushed rocks from the crusher. The fines extracted by the air stream are at least 50% minus 50-mesh.

13 Claims, 3 Drawing Sheets

METHODS FOR RECRUSHING ROCKS AND REMOVING FINES THEREFROM

BACKGROUND

The present invention relates to rock crushing and handling.

As used herethroughout, the term "rock" or "rocks" refers, for example, to granite, limestone, gravel, top rock and other minerals that are to be crushed to form construction materials.

Traditionally, the production of crushed rock for use as construction materials has been performed by blasting away large rocks from the earth, and hauling the large rocks to a processing plant. At the plant, the incoming large rocks are passed through a primary or first-stage crusher that breaks the rocks into smaller pieces which then are further reduced in size by being passed through secondary, third, and at times fourth-stage crushers, such as gyratory cone and impact crushers for example.

After being passed through each of the crushers, the crushed rock is passed across a sizing device such as a screening apparatus that may comprise a plurality of screens with different size holes, in order to classify the rocks according to size. Rocks not passing through a screen may be routed for additional crushing. Rocks that pass through the sizing device are routed for final sorting. During the crushing, very fine material ("fines") is produced which can adhere to the final product. Product gradation specifications often limit the amount of fine material to be included in the final product. Thus, open graded aggregates and some screenings and sand products are often washed to remove excess fines in order to meet product gradation specifications. The materials are then sold for construction materials.

A system for performing the above-described procedure is schematically depicted in FIG. 1 wherein incoming rocks are passed through a first-stage crusher 100 and then conveyed to a first screening apparatus 102. The smallest rocks passing completely through the first screening apparatus at 104 are collected for use as a commercial product, e.g., as road base material. Larger rocks not passing completely through the first screening apparatus are fed to a second-stage crusher 106 in which they are crushed to smaller sizes. Rocks crushed in the second stage crusher 106 are conveyed on a conveyor 107 to a second screening apparatus 108. Smaller rocks passing completely through the second screening apparatus at 110 are collected for use as a commercial product, e.g., as road base material. Medium sized rocks passing only partially through the second screening apparatus are conveyed to a third screening apparatus 112 which classifies those rocks into various sizes and conveys them to washing devices 114, 116, 118, and 119 where they are washed for use as product. Larger rocks are conveyed by a conveyor 120 to a third stage crusher 122 in which they are crushed to yet smaller sizes and returned by a conveyor 124 to the conveyor 107 which conveys them back to the second screening apparatus 108 for re-screening.

As the rock is processed to progressively smaller sizes through the crushing and sizing operations, quantities of very fine particles are generated. A high percentage of the production of these fines occurs in the third-stage crusher (and fourth-stage crusher, if used) where the smallest rocks are being formed.

As the rocks are being conveyed through the system, e.g., between the crushers and the sizing devices, it is necessary to spray the rocks with water by means of sprayers 126 in order to suppress the emission of dust by entraining fines within the sprayed water. Also, a low-volume air flow (e.g., 4,000 cfm) may be circulated around the rocks in order to collect dust generated as the rocks are conveyed.

It will also be appreciated that for many commercial uses, the final crushed rock product needs to be washed in order that adhered and excess fines can be removed therefrom before the rocks are shipped. This is true for both course graded and fine graded products. Therefore, there is a tendency for the final product to require vigorous washing.

The fines removed by washing and spraying are conveyed with the water to treatment facilities such as hydrocyclones, dewatering screens, thickeners and belt presses, or a settling pond 130 as shown in FIG. 1. The fines are then separated from the water which is re-used for washing and spraying. The fine material that is separated from the water has high moisture values, is typically difficult to handle, and has very limited uses. This material is, in most cases, either wasted on site or used as mass fill. It has little or no value, no consistency of gradation or moisture content and is generally a liability to the operation, adding to the expense and complexity of the operation.

It would, therefore, be desirable to provide methods and apparatus for producing crushed rock in a manner which minimizes the amount fine material that must be removed by washing and, in some instances, even eliminate the need for washing altogether.

It would also be desirable to produce crushed rock which is cleaner (i.e., carries less dust) and requires less vigorous washing operations.

It would also be desirable to enable fines produced during rock-crushing operations to be recovered in a state suitable for sale as a commercial product.

SUMMARY OF THE INVENTION

One aspect of the present invention relates to a method of providing crushed rock, which comprises the steps of:

A. passing rock through an early-stage rock crusher;

B. passing the crushed rocks that exit the early stage rock crusher across a sizing device; and C. recrushing, in a later-stage rock crusher, rocks from step B that fail to pass completely through the sizing device; and D. passing an air stream transversely through the recrushed rocks as the recrushed rocks flow downwardly toward an exit of the later-stage rock crusher, wherein the air stream extracts fines form the recrushed rocks prior to the crushed rocks exiting the later-stage crusher.

Preferably, the fines extracted by the air stream in step C are at least 50% minus 50-mesh, more preferably at least 30% minus 200-mesh.

Another aspect of the invention relates to a rock crushing apparatus which comprises a base, a crusher unit disposed in the base and including an upper inlet for receiving rocks, a crusher component for crushing the rocks, and a lower outlet for discharging the crushed rocks as a downwardly flowing rock/fines mass. A fines-extraction passage is disposed within the base below the outlet and arranged transversely through the downwardly flowing rock/fines mass. An air stream generating mechanism communicates with the fines-extraction passage for generating a flow of air therethrough and through the downwardly flowing rock/fines mass for extracting fine dust therefrom prior to exiting of the crushed rocks from the base.

BRIEF DESCRIPTION OF THE DRAWINGS

Objects and advantages of the invention will become apparent from the following detailed description of preferred embodiments thereof in connection with the accompanying drawing in which like numerals designate like elements.

DETAILED DESCRIPTION OF A PREFERRED EMBODIMENT OF THE INVENTION

Figure 1:
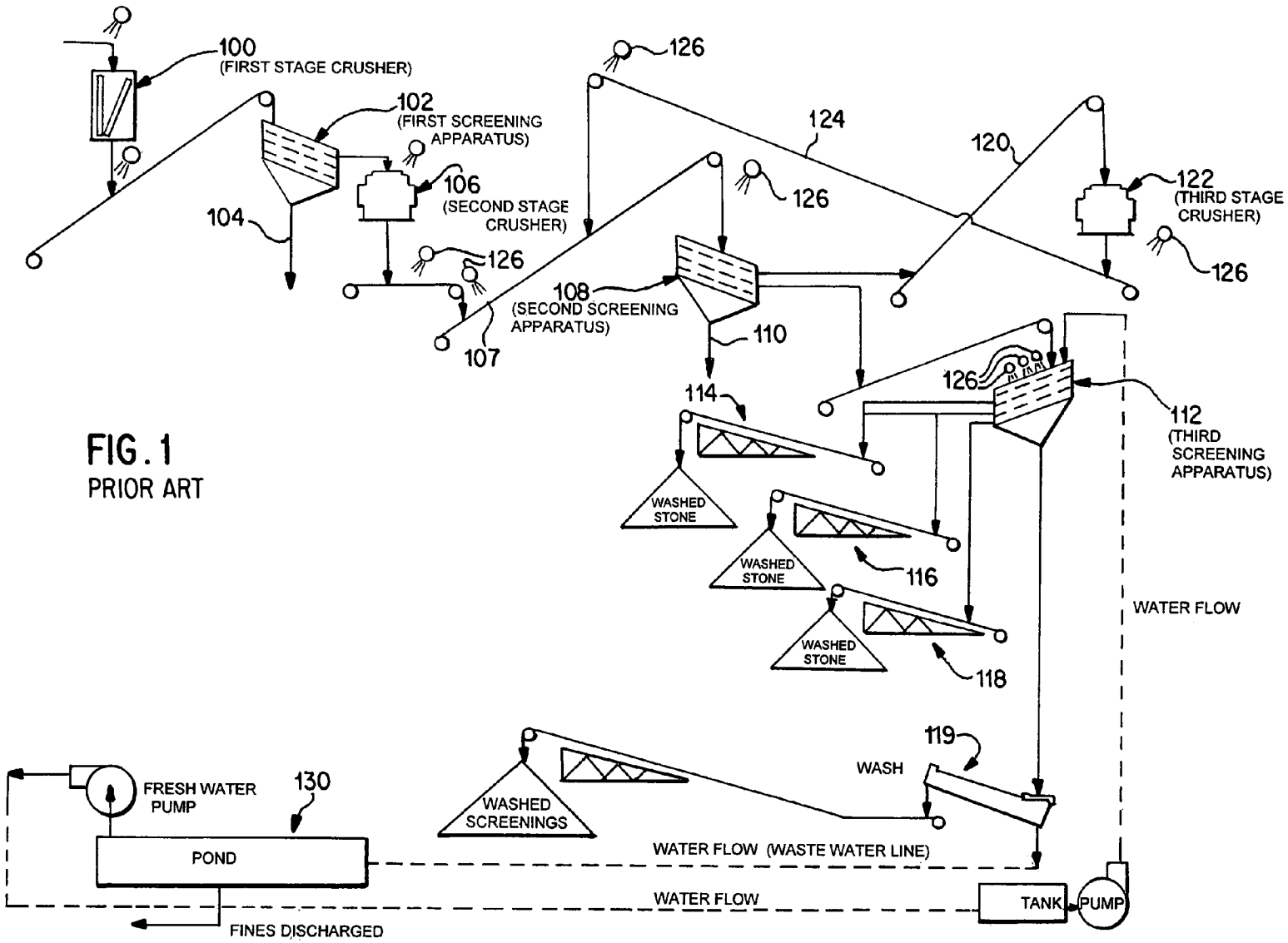
FIG. 1 PRIOR ART
FIG. 1 is a diagrammatic view of a prior art rock crushing/handling system.
Figure 2:
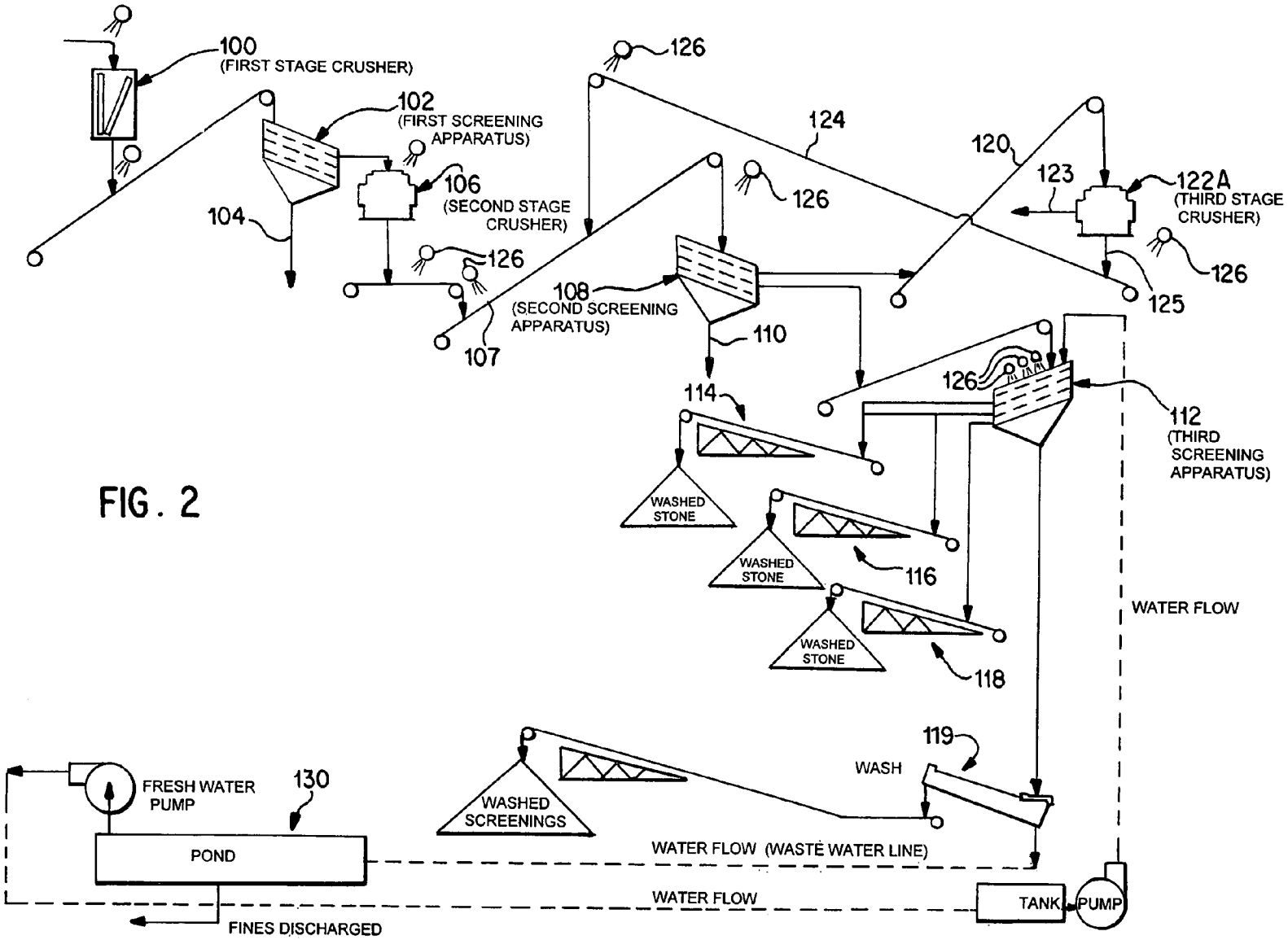
FIG. 2 is a view similar to FIG. 1 depicting a rock crushing/handling system according to the present invention.
Figure 3:
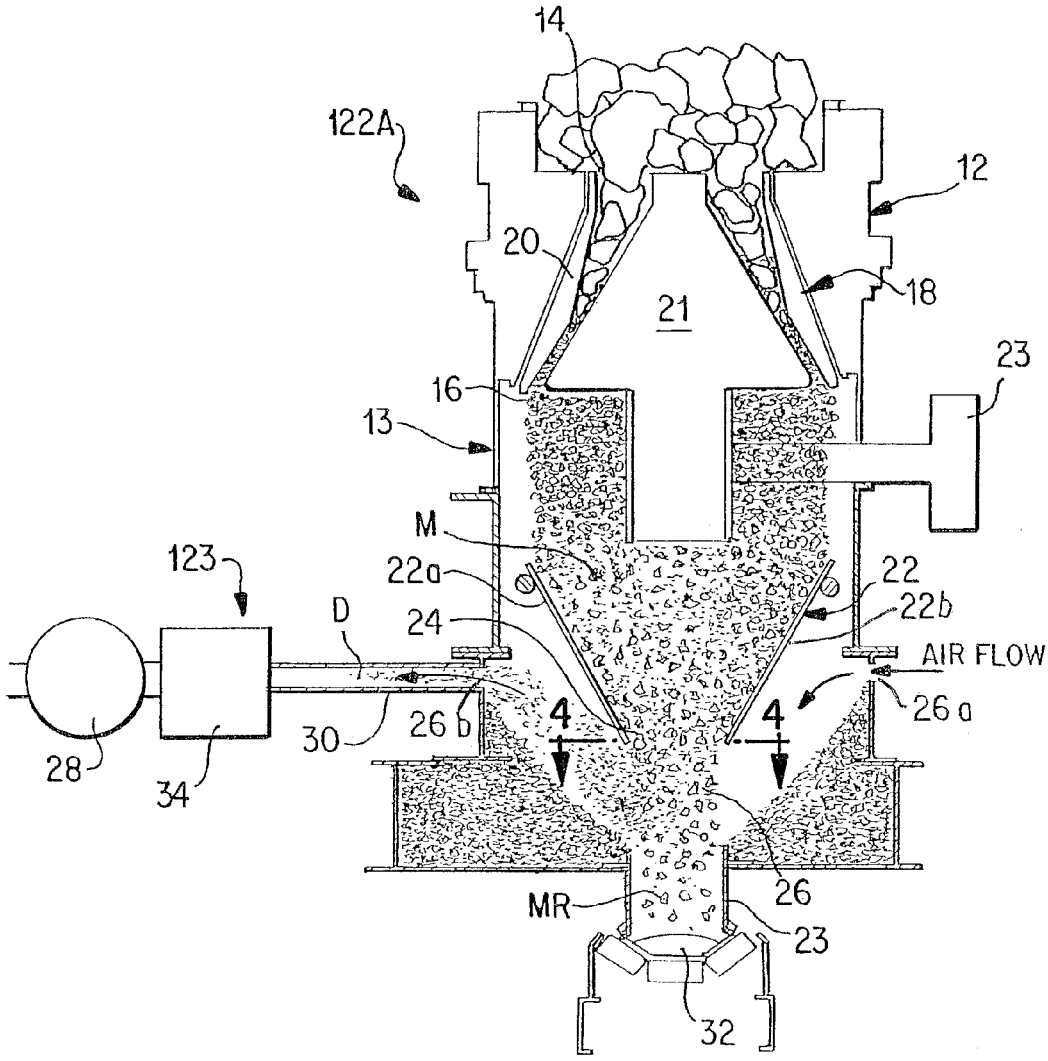
FIG. 3 is a vertical sectional view taken through a rock crushing apparatus according to the present invention.

Depicted in FIG. 2 is a schematic view similar to that of FIG. 1 but showing that, in accordance with the present invention, a fine material extraction procedure is performed in a novel final-stage crusher 122A shown in FIG. 3 (usually a third-stage crusher), wherein fines are removed at 123. Thus, the crushed rocks leaving that crusher at 125 are accompanied by considerably fewer fines. Accordingly, less dust-suppressing water is needed, which means that the rocks will be drier with fewer fines adhering thereto (i.e., the rocks are relatively clean), requiring a less vigorous washing step, e.g., only a rinsing step at a rinsing station may be needed. Consequently, since fewer fines are to be removed from the water and disposed of, production costs are reduced. Moreover, the fines extracted at 123 from the third crushing stage 122A are in an essentially dry state capable of being easily recovered for sale as a commercial product.

More particularly, there is depicted in FIG. 3 the rock crushing apparatus 122A particularly suitable for use as a final-stage rock crusher (e.g., third-stage or fourth-stage) in accordance with the invention. That crushing apparatus 122A includes a rock crushing unit 12 having a base 13 forming an upper inlet 14, a lower outlet 16, and a crusher unit 18 disposed therebetween. For example, the crusher unit 18 could comprise a conventional gyratory cone crusher of the type described in U.S. Pat. No. 6,565,025, or any other suitable type of rock crusher. In a gyratory cone crusher, rocks are fed downwardly between a stationary element 20 and a crusher unit in the form of a gyratory conical mantle 21 which is gyrated by a power mechanism 23, thereby crushing the rocks against the stationary element 20.

Figure 4:
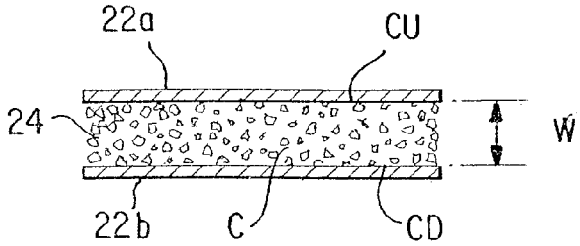
FIG. 4 is a sectional view taken along line 4-4 in FIG. 3 as crushed rock is flowing through a gathering device.

Thus, a downwardly flowing mass M of crushed rocks and fine particles (fines) passes through the outlet 16 of the crusher unit 18 and then travels downwardly through a gathering apparatus 22 which gathers the mass M into the form of a vertical column C of crushed rocks, the column having a generally rectangular cross section, as shown in FIG. 4. As that column C travels downwardly toward an exit 23 of the crusher base 13, it passes through a transverse fines-extraction passage 26, i.e., a passage oriented transversely (preferably perpendicularly) relative to the downward direction of flow of the rock/fines mass M. The transverse passage 26 communicates with first and second air ports 26*a*, 26*b* disposed on opposite sides of the column C. The port 26*a* communicates with ambient air, and the port 26*b* communicates with a downstream suction device 28. The passage 26 conducts a high-volume air stream (e.g., at least 10,000-40,000 cfm depending upon the size of the crusher and characteristics of the product such as specific gravity, etc.) which removes fines from the mass M.

The gathering device 22 may comprise a pair of plates 22*a*, 22*b* that converge downwardly toward an outlet 24 formed by the plates. It will be appreciated that the mass of rocks M passing through the outlet 16 of the crusher unit 18 is generally in the form of a ring of crushed rocks (the center of the ring lying on a vertical center axis of the crusher unit 18). That ring-shaped mass is reconfigured into the column shape C by the gathering device 22, so that the upstream and downstream sides CU, CD of the column (considered with reference to the flow direction of the transverse air stream through the passage 26) are oriented generally parallel to one another and perpendicular to the transverse air stream flowing through the fines-extraction passage 26. Accordingly, a constant width W of the column C will be subjected to the air flow, so all regions of the mass M will be subjected to an equal contact with the air flow. The outlet opening 24 of the gathering device 22 is adjustable in order to be able to vary the width W of the column C. For example, either or both of the plates 22*a*, 22*b* could be adjusted by being rotated about a horizontal axis 22*c* arranged along an upper edge thereof to change the convergence angle of the plates.

The air flow through the passage 26 is generated by the suitable suction-type air stream generator 28 which communicates with a downstream end of the transverse passage 26. In lieu of the suction device, a blower (not shown) could be used which would be positioned to blow high-volume air toward the passage 26. However, the use of a suction-type air stream generator located downstream of the transverse passage is preferable to the use of a blower-type generator located upstream of the transverse passage, because the suction device draws air inwardly through any openings, gaps, etc. existing in the base of the apparatus 122A. In contrast, a blower located upstream of the apparatus would tend to undesirably blow air/fines out through such openings/gaps.

As noted above, as the air stream in the transverse passage 26 passes transversely through the downwardly flowing mass of crushed rocks and fines, the fines in the rock/fines mass M become entrained in the air stream and are extracted from the mass M. A fines-laden air stream D is thus formed which is carried off through a conduit 30. The mass MR of crushed rock from which the fines have been extracted, falls onto conveyor belt 124, e.g. for travel back to the screening apparatus 108. The fines-laden air stream MD is conducted to a fines-separating device 34 located upstream of the suction device 28. The fines-separating device 34 could comprise a filter, or an air-classifier in which the speed of the air flow is gradually slowed to enable the heavier and lighter fines particles to gravitate-out successively. Air-classifiers have long been known, e.g., see U.S. Pat. No. 197,897.

The size (weight) of the fine particles D that are extracted from the mass M within the crushing apparatus 122A can be controlled by suitable regulation of the speed of the air stream passing through the passage 26, and/or by adjusting the convergence angle of the gathering plates 22*a*, 22*b* which, in turn, changes the column width W and determines the density of the rock/dust mass M falling through the opening 24 into the air stream. Preferably, the fine particles which are extracted from the mass M are characterized as being "at least 50% minus 50-mesh," meaning that at least 50% of the extracted fine particles could pass through a 50-mesh screen. More preferably, the extracted fine material is even smaller, e.g., "at least 30% minus 200-mesh," meaning that at least 30% of the extracted fines could pass through a 200-mesh screen.

It will be appreciated that by removing fine particles from the rock crushed within the crusher 122A itself, rather than allowing the fines to exit the crusher along with the crushed rocks, less dust is generated, so the dust suppression requirements are reduced. That, in turn, reduces the amount of water that needs to be sprayed on the crushed rock exiting the crusher, as well as reducing the amount of fine material that is collected in the wash/spray water which has to be separated and disposed of. Moreover, the reduced water spray means that the crushed rock is drier, so less fine particles adhere thereto, and a less vigorous rock-washing step is needed; perhaps only a mild rinsing operation needs to be performed. Depending upon the use to which the crushed rock product is to be used, it may even be possible to omit the washing/rinsing step. Also, the fines can be collected in a dry state, wherein they can be more easily handled and collected, and even be sold as commercial product.

Those reduced spraying, fines-handling, and washing requirements mean that the overall production costs are reduced.

Although the provision of a transversely-flowing fines-extracting air stream has been disclosed herein only in conjunction with the final-stage rock crusher 122A, it could also be used in conjunction with an earlier-stage rock crusher 106, although the resulting benefits would not be as great since fewer fines are produced in earlier-stage rock crushers than in the final-stage rock crusher.

The fines-extraction aspect of the invention can be applied on impact type crushers, as well as gyratory cone type crushers.

It will be appreciated that the present invention allows the separation of very fine particles from larger particles by incorporating a high volume air stream to the material flow within the crusher collection box immediately after the material is crushed. Application of this method will provide the user with a marketable product that is not commonly available now, will lower production cost by reducing waste and associated handling, and improve the performance of emission control and material washing equipment.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of providing crushed rock, comprising the steps of:

A. passing rocks through an early-stage rock crusher;

B. passing crushed rocks from the early-stage rock crusher to a sizing device;

C. recrushing, in a later-stage rock crusher unit, rocks from step B that fail to pass completely through the sizing device;

D. constraining the recrushed rocks to gravitate downwardly toward an exit of the later-state rock crusher unit in the form of a column of recrushed rocks;

E. providing first and second air ports on opposite sides of the recrushed rock column wherein the first air port communicates with ambient air; and F. generating suction at a location downstream of the second air port which communicates with the second air port, to cause ambient air to be sucked transversely through the recrushed rock column from the first air port to the second air port to extract fines from the recrushed rock column prior to the recrushed rocks exiting the later-stage crusher unit.

2. The method according to claim 1 wherein the recrushed rocks exiting the later-stage rock crusher fall onto a conveyor belt after passing through the air stream.

3. The method according to claim 1 wherein the rocks recrushed by the later-stage rock crusher are passed downwardly through a gathering device disposed above the air stream, the gathering device configuring the recrushed rocks generally into the recrushed rock column which has upstream and downstream sides with reference to the flow direction of the transverse air stream, the upstream and downstream sides being generally parallel to one another.

4. The method according to claim 3 wherein the upstream and downstream sides of the column are arranged generally perpendicularly to the transverse air stream.

5. The method according to claim 3 wherein the later-stage rock crusher includes a vibratory crusher which discharges recrushed rocks in the form of a ring of recrushed rocks which enters an upper end of the gathering device to be reconfigured thereby into said column having a rectangular cross-section.

6. The method according to claim 1 wherein the fines extracted by the air stream in step F are at least 50% minus 50-mesh.

7. The method according to claim 1 wherein the fines extracted by the air stream in step F are at least 30% minus 200-mesh.

8. The method according to claim 1 wherein the air stream passes substantially perpendicularly through the recrushed rocks in step F.

9. The method according to claim 1 wherein the later-stage rock crusher comprises a gyratory cone crusher or an impact crusher.

10. The method according to claim 1 wherein the later-stage rock crusher constitutes a final-stage rock crusher.

11. The method according to claim 1 wherein the air stream has a flow volume of at least 10,000 cfm.

12. The method according to claim 1, wherein fines-laden air passes through the second air port and is thereafter treated to remove the fines therefrom.

13. The method according to claim 12 wherein the treating of the fines-laden air comprises filtering.

* * * * *